US007973943B2

(12) United States Patent
Jose et al.

(10) Patent No.: US 7,973,943 B2
(45) Date of Patent: Jul. 5, 2011

(54) DETERMINING TRACK ORIGIN

(75) Inventors: Honey Jose, Milton Keynes (GB); Ian Tindall, Bournemouth (GB); John Sanders, Barford (GB)

(73) Assignee: Molins PLC, Milton Keynes (GB)

( * ) Notice: Subject to any disclaimer, the term of this patent is extended or adjusted under 35 U.S.C. 154(b) by 0 days.

(21) Appl. No.: 12/615,357

(22) Filed: Nov. 10, 2009

(65) Prior Publication Data

US 2010/0118314 A1 May 13, 2010

(30) Foreign Application Priority Data

Nov. 11, 2008 (GB) ..... 0820647.6

(51) Int. Cl.
*G01B 11/02* (2006.01)
*G01B 11/06* (2006.01)

(52) U.S. Cl. ..... 356/634; 356/614; 356/635

(58) Field of Classification Search ..... None
See application file for complete search history.

(56) References Cited

U.S. PATENT DOCUMENTS

| | | | | |
|---|---|---|---|---|
| 4,571,497 | A * | 2/1986 | Henry et al. | 250/559.19 |
| 5,228,462 | A * | 7/1993 | Osmalov et al. | 131/905 |
| 5,414,270 | A | 5/1995 | Henderson et al. | |
| 6,020,969 | A * | 2/2000 | Struckhoff et al. | 356/430 |
| 6,198,537 | B1 * | 3/2001 | Bokelman et al. | 356/429 |
| 2006/0098214 | A1 * | 5/2006 | Wilson et al. | 356/634 |

FOREIGN PATENT DOCUMENTS

| | | | |
|---|---|---|---|
| EP | 0 548 695 | A2 | 6/1993 |
| EP | 0 570 163 | A2 | 11/1993 |
| EP | 1 830 179 | A1 | 9/2007 |
| GB | 2 275 335 | A | 8/1994 |
| GB | 2473230 | A | 3/2011 |
| WO | WO 2004/083834 | A1 | 9/2004 |

* cited by examiner

*Primary Examiner* — Gregory J Toatley
*Assistant Examiner* — Juan D Valentin
(74) *Attorney, Agent, or Firm* — Woodard, Emhardt, Moriarty, McNett & Henry LLP

(57) ABSTRACT

Apparatus is disclosed for determining the track of origin of a cigarette manufactured in a cigarette making machine having a plurality of tracks. The cigarette making machine (60) is arranged such that the circumferential position of the tipping paper seam and the circumferential position of the tobacco wrapping paper seam are different for different tracks. The apparatus comprises a detector (20, 22; 36; 50) arranged to detect radiation from the cigarette (18) and to produce a signal representative of the detected radiation, and a processor (30; 54) arranged to process the signal produced by the detecting means to identify a shadow cast by a tipping paper seam and a shadow cast by a wrapping paper seam. The processor (30; 54) is arranged to determine a difference in the circumferential position of the shadow cast by the tipping paper seam and the circumferential position of the shadow cast by the wrapping paper seam, and to produce a signal indicating the track of origin of the cigarette in dependence thereon.

14 Claims, 5 Drawing Sheets

DETERMINING TRACK ORIGIN

CROSS REFERENCES TO RELATED APPLICATIONS

This application claims priority to United Kingdom Patent Application No. GB0820647.6, filed Nov. 11, 2008, entitled "DETERMINING TRACK ORIGIN", which reference is expressly incorporated by reference herein, in its entirety.

BACKGROUND OF THE INVENTION

The present invention relates to techniques for determining track origin in a cigarette making machine.

Filter tip cigarettes are generally made in pairs in cigarette making machines. In such machines a filter tip has a tobacco column wrapped in paper applied to each end. The filter tip is fixed in place by wrapping a filter tipping paper about the filter and the end of each of the two tobacco columns. The whole rod is then placed into a slitter, which cuts the rod at the centre of the filter plug to form two cigarettes. Such a machine thus produces two lines of cigarettes simultaneously. The cigarettes are ejected onto a transport system known as a mass flow.

In order to increase the speed of cigarette manufacture, twin track cigarette making machines have been produced, in which a second making track is incorporated into the machine. Each of the tracks produces two lines of cigarettes, in the way described above. The cigarettes from both tracks are mixed in the mass flow.

In cigarette making machines, quality control measures are usually taken, and adjustments are made to the machine to ensure that the cigarettes meet the required specification. In addition, a further quality control step is usually employed, whereby a sample of cigarettes is selected from the mass flow and subjected to more stringent tests. When performing such tests, it may be desirable to know the line and track from which the cigarette originates.

WO 2004/083834 discloses a technique for determining the direction of wrapping of cigarette wrapping paper. In a single-track machine, the cigarettes in the mass flow may be wrapped either clockwise or counter-clockwise. By determining the wrapping direction, it may be possible to identify the line from which the cigarette originates.

However, using existing techniques, it is not possible to determine the track from which a cigarette originates in a twin-track cigarette making machine once the cigarette is mixed in the mass flow.

BRIEF SUMMARY

According to an aspect of the present invention there is provided apparatus which determines the track of origin of a cigarette manufactured in a cigarette making machine having a plurality of tracks, the apparatus comprising a detector arranged to detect radiation from the cigarette and to produce a signal representative of the detected radiation, and a processor arranged to process the signal produced by the detector to identify a shadow cast by a tipping paper seam and a shadow cast by a wrapping paper seam. The processor is arranged to determine a difference in the circumferential position of the shadow cast by the tipping paper seam and the circumferential position of the shadow cast by the wrapping paper seam, and to produce a signal indicating the track of origin of the cigarette in dependence thereon.

The present invention may provide the advantage that the track of origin can be determined from a cigarette sampled from the mass flow, without the need to stop the machine or to sample separately from the two tracks.

The present invention is based on a realisation that it may be possible to set a cigarette making machine such that the circumferential position of the tipping paper seam relative to the circumferential position of the tobacco wrapping paper seam is different for different tracks. Thus, by determining a difference between the circumferential position of the tipping paper seam and the circumferential position of the tobacco wrapping paper seam, it may be possible to determine the track of origin.

In a multi-track cigarette making machine, variations in the cigarettes may occur from one track to another. By determining the track of origin, adjustments can be made to the appropriate part of the machine.

DETAILED DESCRIPTION

Figure 1:
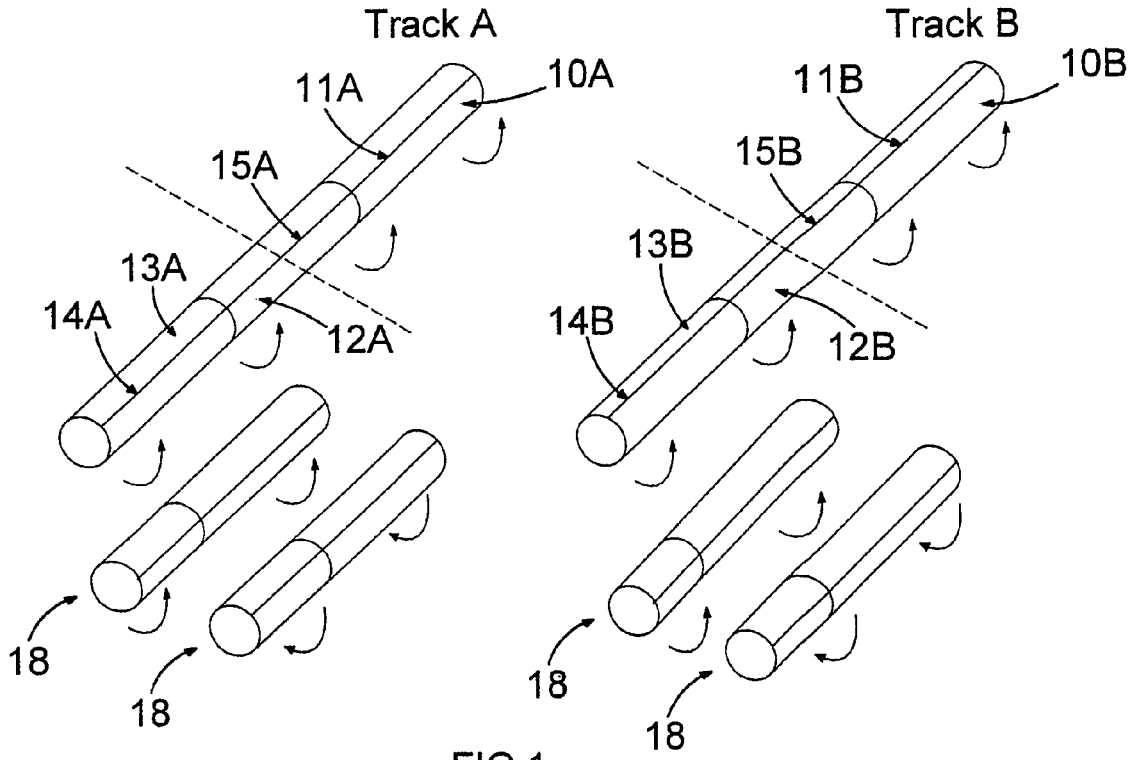
FIG. 1 shows diagrammatically a cigarette making process.

For the purposes of promoting an understanding of the disclosure, reference will now be made to the embodiments illustrated in the drawings and specific language will be used to describe the same. It will nevertheless be understood that no limitation of the scope of the disclosure is thereby intended, such alterations and further modifications in the illustrated device and its use, and such further applications of the principles of the disclosure as illustrated therein being contemplated as would normally occur to one skilled in the art to which the disclosure relates.

In its most general form, an embodiment of the present invention relates to an apparatus for determining the track of origin of a cigarette manufactured in a cigarette making machine having a plurality of tracks, the apparatus comprising detecting means arranged to detect radiation from the cigarette and to produce a signal representative of the detected radiation, and processing means arranged to process the signal produced by the detecting means to identify a shadow cast by a tipping paper seam and a shadow cast by a wrapping paper seam. The processing means is arranged to determine a difference in the circumferential position of the shadow cast by the tipping paper seam and the circumferential position of the shadow cast by the wrapping paper seam, and to produce a signal indicating the track of origin of the cigarette in dependence thereon.

Preferably the apparatus comprises means for detecting radiation from (e.g. reflected from and/or emitted by) the cigarette. The detected radiation may then be used to determine a difference between the circumferential position of the tipping paper seam and the circumferential position of the tobacco wrapping paper seam. This may allow a non-contact method to be used to determine the track of origin. A non-contact method may be desirable in order to avoid disturbing the properties of the cigarette.

The detecting means may comprise any kind of device which is capable of detecting radiation from the cigarette and converting it into an electrical signal. For example, the detecting means may comprise a light sensor such as a photodiode or a photocell or any other device for detecting electromagnetic radiation.

In another embodiment, the detecting means comprises an imaging device for imaging the cigarette. The imaging device may be a digital camera, and may produce a digital image of the cigarette.

In another embodiment, the detecting means comprises a contact image sensor such as that disclosed in co-pending United Kingdom patent application number 0915394.1. For example, the contact image sensor may comprise a single linear array of image sensors. Although the term "contact sensor" is used, the sensor need not be in direct contact with the cigarette, but may be arranged in close proximity to the cigarette, for example, less than 50 mm or less than 10 mm. This embodiment may provide high magnification of a narrow strip along the length of the cigarette, and thus allow imaging of the whole cigarette with high resolution.

The detecting means may comprise a filter, which may be used to enhance the contrast between a shadow cast by a seam, and another part of the cigarette.

By analysing an output of the detecting means, the determining means may be able to detect a shadow cast by the tipping paper seam and a shadow cast by the wrapping paper seam. This may be used to determine the relative positions of the seams and/or the directions of the seams. For example, the determining means may be arranged to determine a difference in the circumferential position of the shadow cast by the tipping paper seam and the circumferential position of the shadow cast by the wrapping paper seam. Alternatively or in addition the determining means may be arranged to determine a difference in the size and/or direction of the shadow cast by the tipping paper seam and the size and/or direction of the shadow cast by the wrapping paper seam. In a further alternative arrangement the extra brightness of the overlapping seam in comparison with the body of the rod may be used to determine the size and or direction of the seam. In this way a light intensity difference between seam and bulk of the wrapper may be used.

In order to facilitate reliable illumination of the cigarette, the apparatus may further comprise means for emitting radiation towards the cigarette. The emitting means may emit any form of electromagnetic radiation, such as visible light, infrared or ultra violet light. The emitting means may emit substantially coherent radiation, or broad band radiation. For example, the emitting means may be a light emitting diode (LED) or a laser diode. The detecting means is preferably arranged to detect the radiation emitted by the emitting means and reflected by the cigarette.

The emitting means may be arranged to emit radiation obliquely towards the surface of the cigarette. In this way, shadows may be cast by the tipping paper and tobacco paper seams, which may facilitate detection of the seams. Thus the emitting means may be arranged to emit radiation at an angle to the surface of the cigarette such as to cause a shadow to be cast by a seam in the tipping paper and/or tobacco wrapping paper. Similarly, the detecting means may be arranged to detect radiation at an angle which is oblique to the surface of the cigarette, which may assist in detecting the seams.

The emitting means may comprise two emitters located on either side of the cigarette, and arranged to emit radiation obliquely towards the cigarette from either side. This may allow a shadow to be cast by a seam regardless of wrapping direction, and thus may facilitate detection of the seams. The emitters may be located at different positions along the cigarette, and/or may be shielded from each other, and/or may emit radiation at different times and/or of a different wavelength, in order to reduce interference between the two.

The emitting means and/or the detecting means may comprise a lens, which may be used to focus radiation emitted towards or detected from the cigarette. This may assist in creating a discernable shadow at the seam. Alternatively or in addition the emitting means and/or the detecting means may comprise a filter, which may be used to enhance the contrast between a shadow cast by a seam, and another part of the cigarette.

In one embodiment, the apparatus comprises an emitter/detector pair for emitting radiation towards the cigarette and detecting radiation from the cigarette. A first emitter/detector pair may be located adjacent the filter tip, and a second emitter/detector pair may be located adjacent the tobacco column, in order to determine a difference between a parameter of the tipping paper seam and a parameter of the tobacco wrapping paper seam. Alternatively, a single emitter/detector pair may be provided, and the apparatus may further comprise means for adjusting the relative positions of the cigarette and the emitter/detector pair such that the emitter/detector pair can emit radiation towards and detect radiation from the tipping paper and the tobacco paper sequentially.

In another arrangement, two emitter/detector pairs may be located adjacent the cigarette filter, and two emitter/detector pairs may be located adjacent the tobacco column. In this case, the filter and tobacco column may both be irradiated from one side by one emitter and from the other side by another emitter. This may allow the seams to be detected with greater certainty regardless of the wrapping direction.

The apparatus may comprise a processor for processing a signal produced by the detecting means. For example, the processor may be arranged to detect a change in the amount of radiation detected by the detecting means as the cigarette is rotated. For example, a dip in the amount of detected radiation may indicate the presence of a seam in the field of view, while the amount of the dip may indicate the direction of the seam. Where the detecting means comprises an imaging device, the image may be analysed by the processor to determine the position and/or direction of a shadow cast by the seam in the image.

Preferably the apparatus comprises means for rotating the cigarette relative to an emitter and/or a detector. This may be achieved either by rotating the cigarette, for example about its axis, or by rotating the emitter and/or detector about the cigarette, or a combination of the two. By rotating the cigarette, the seams may be brought into the field of view of the detecting means. Rotating the cigarette may also facilitate determination of the difference between the circumferential position of the tipping paper seam and the circumferential position of the tobacco wrapping paper seam, by determining a difference between the times at which the seams are brought into the field of view. Preferably the cigarette and/or emitter and/or detector are rotated about the axis of the cigarette, although they could be rotated in some other way such as about its periphery.

Alternatively or in addition, a radiation beam (such as a light beam) may be scanned over the surface of the cigarette, and the reflected radiation may be detected and analysed in order to determine the position and/or direction of the tipping paper seam and the tobacco paper seam. Any combination of the above techniques may be used.

The apparatus may comprise control means for controlling the rotating means. The control means may be arranged to start and stop rotation, and/or to control the speed at which the cigarette is rotated. The control means may be part of a processor for processing a signal produced by the detecting means, or a signal from the control means may be fed to such a processor. The processor may then use knowledge of the speed of rotation to determine the angle between the tipping paper seam and the tobacco paper seam.

In one embodiment, the detecting means comprises a detector array positioned such that its field of view is at an angle across the line of an expected seam of the cigarette, and the determining means comprises a processor arranged to detect a change in the intensity of adjacent pixels of the detector array as the cigarette rotates. As the cigarette is rotated the change in intensity due to the overlap of the seam will be seen to "march" across the detector. By comparing the shift in signal of adjacent pixels in the array the seam can be detected regardless of the wrapping detection.

The apparatus may also be arranged to determine the line within a track from which the cigarette originates. This may be achieved by determining the wrapping direction of the tobacco paper and/or the tipping paper. Thus the apparatus may further comprise means for determining the wrapping direction of the tobacco paper and/or the tipping paper to produce an indication of line of origin. For example, the apparatus may be arranged to determine the direction of a seam, in any of the ways described above.

The apparatus may be integrated into test station that analyses samples taken from the mass flow. Thus, there may be provided a test station for analysing cigarettes from a cigarette making machine having a plurality of tracks, the test station comprising apparatus for determining the track of origin in any of the forms described above. The apparatus and/or test station may also be integrated into the cigarette making machine, and thus there may be provided a cigarette making machine comprising an apparatus or a test station in any of the forms described above.

As noted above, the present invention is based on a realisation that it may be possible to set a cigarette making machine such that a parameter of the tipping paper seam and a parameter of the tobacco wrapping paper seam are different for different tracks. Thus, there may be provided a cigarette making machine having a plurality of tracks, wherein the machine is set such that a parameter of the tipping paper seam and a parameter of the tobacco wrapping paper seam are different for different tracks.

FIG. 1 shows diagrammatically how a twin track cigarette making machine produces cigarettes with different lap directions. Referring to FIG. 1, cigarettes are manufactured in two tracks, track A and track B. In track A, a tobacco column 10A is first wrapped in cigarette paper the edge of which creates a seam 11A. The filter plug 12A is then applied to one end, and a second wrapped tobacco column 13A with seam 14A is applied to the other end of the filter plug. The filter is affixed in place by wrapping filter tipping paper about the two tobacco columns, 13A and 10A and the filter plug 12A. The edge of the filter tipping paper creates a seam 15A. The whole rod is then placed in a slitter which cuts the rod at the centre, as shown by the dashed line, to form two cigarettes 18. A similar process takes place simultaneously in track B. The cigarettes from both tracks are then ejected into the mass flow.

In FIG. 1, the "front" cigarette 13A, 13B in each track has its cigarette paper and filter tipping paper wrapped in a clockwise direction when viewed from the filter end, while the "back" cigarette 10A, 10B in each track has its cigarette paper and filter tipping paper wrapped in an anti-clockwise direction. The opposite wrapping directions of the "front" and "back" cigarettes are a consequence of the cigarette making process, and can be used to determine the line of origin in the way disclosed in WO 2004/083834. However these techniques do not allow the track of origin to be identified.

In a twin-track cigarette making machine it may be necessary to make separate adjustments to the two tracks. Thus, when sampling and testing cigarettes, it is desirable to know the track from which the cigarette originated. Any method for determining the track of origin should preferably be affordable, reliable and easily maintained, and not involve an interruption to making or affect the properties of the cigarette.

Embodiments of the present invention relate to techniques for determining the track of origin of a cigarette when discharged into the mass flow of a making machine. This can provide the ability to make corrective actions to the appropriate part of the making machine in order to modify the making process and so to correct any deviation from specified manufacturing tolerances, without the need to stop the machine or to sample separately from the two tracks.

Figure 2:
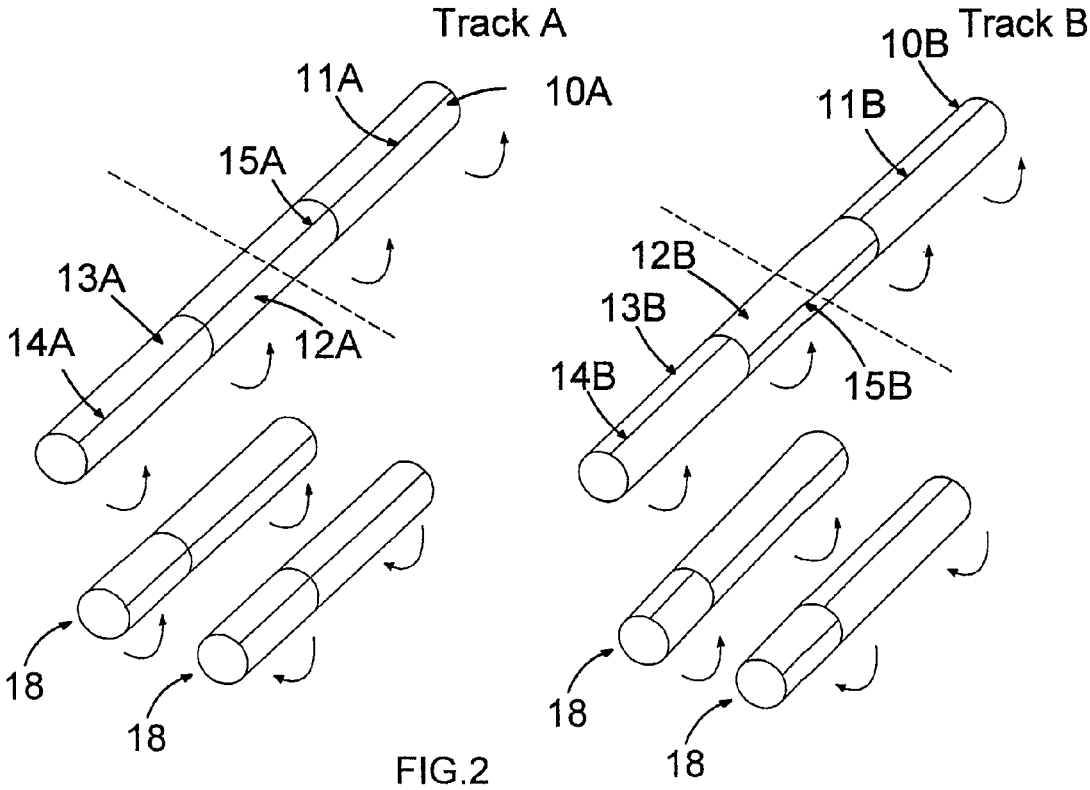
FIG. 2 shows diagrammatically a cigarette making process in accordance with an embodiment of the invention.

It is possible to set a cigarette making machine such that the angle between the tipping paper seam and the tobacco column seam is different for the two tracks. FIG. 2 shows diagrammatically a cigarette making process in a machine which has been set in this way. In the arrangement in FIG. 2, four cigarettes 18 are produced in a similar way to that described with reference to FIG. 1. However, referring to FIG. 2, it can be seen that, in track A, the seams of the cigarette papers 11A and 14A are substantially aligned with the seam of the tipping paper 15A. By contrast, in track B, there is an angle between the seams 11B and 14B of the cigarette paper and that of the filter paper 15B. As a consequence, track A produces two cigarettes with aligned seams and track B produces two cigarettes with unaligned seams.

It can also be seen from FIG. 2 that, as in FIG. 1, the "front" and "back" cigarettes in each track have opposite wrapping directions as a consequence of the making process.

Figure 3:
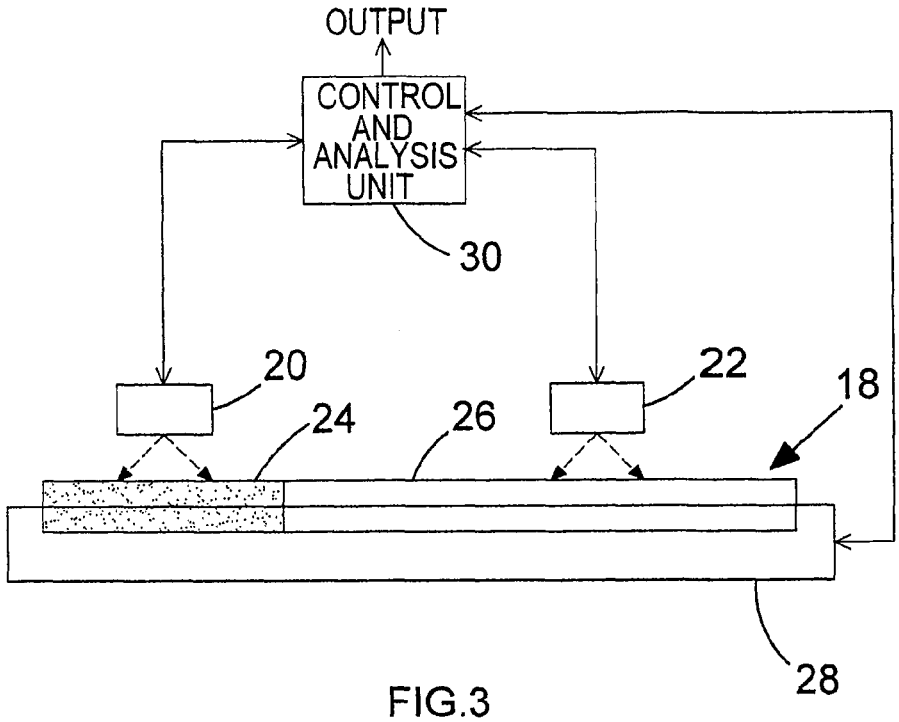
FIG. 3 shows a side view of parts of a testing apparatus according to an embodiment of the invention.

FIG. 3 shows a side view of parts of a testing apparatus according to a first embodiment. Referring to FIG. 3, the testing apparatus comprises two emitter/detector pairs 20, 22. The first emitter/detector pair 20 is located adjacent the filter 24 of a cigarette 18, while the second emitter/detector pair 22 is located adjacent the tobacco column 26. The cigarette 18 is located in a rotating unit 28. A control and analysis unit 30 controls the operation of the emitter/detector pairs 20, 22 and the rotating unit 28. The control and analysis unit 30 also outputs a signal indicating track and/or line of origin of the cigarette.

Figure 4:
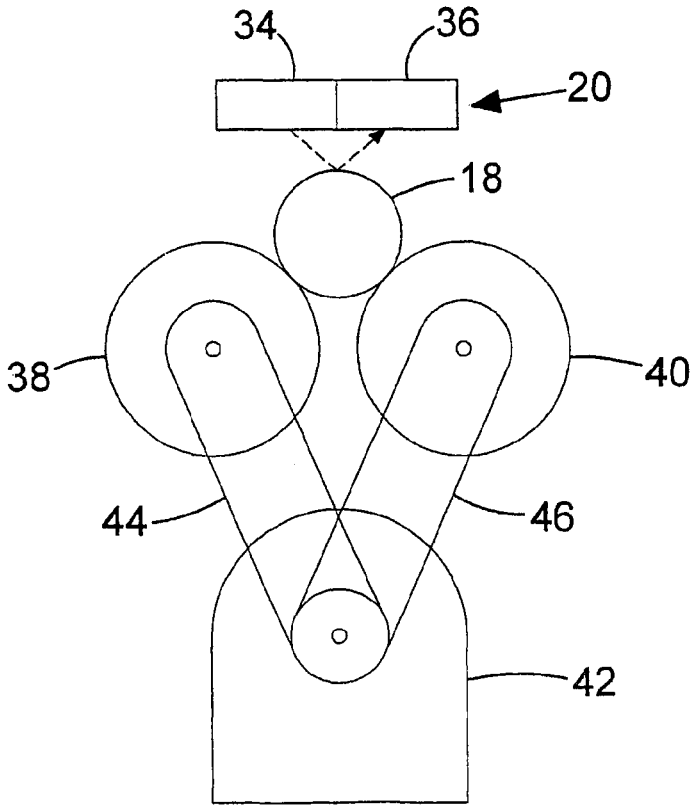
FIG. 4 shows an end view of parts of a testing apparatus in an embodiment that employs rollers as a means of rotation.

FIG. 4 shows an end view of parts of the testing apparatus of FIG. 3. Referring to FIG. 4, emitter/detector pair 20 comprises emitter 34 and corresponding detector 36. Emitter 34 emits electromagnetic radiation, such as visible light, infrared or ultra violet light, towards cigarette 18. Detector 36 detects the radiation produced by emitter 34 and reflected by the cigarette 18, and produces a corresponding electrical signal. The angle between the emitter 34 and detector 36 is chosen such that it enhances any contrast between the main body of the paper of the rod and the region where a seam is present. This contrast can be enhanced by the use of an optical bandpass filter (not shown) over either the detector or emitter. Although not shown in FIG. 4, the emitter/detector pair 22 of FIG. 3 is arranged in a similar way.

The emitter 34 can be of a coherent nature or broad band spectrum. For example, the emitter may be a light emitting diode (LED) or a laser diode, while detector 36 may be a photodiode or similar device.

As mentioned above, cigarette 18 is located in a rotating unit 28. In the arrangement shown in FIG. 4, the rotating unit 28 comprises two rollers 38, 40, a motor 42, and respective drive mechanisms 44, 46. The motor 42 operates under control of the control and analysis unit 30. As the motor rotates, the drive mechanisms 44, 46 transfer rotation of the motor into rotation of the rollers. In this embodiment, the motor is a stepper motor and the drive mechanisms comprise pulleys or gears arranged such that the two rollers 38, 40 rotate in the same direction. Rotation of the two rollers 38, 40 causes the cigarette 18 to rotate about its axis in the opposite direction. In an alternative arrangement (not shown), rotation of the cigarette is by means of a rotating chuck holding the cigarette in place either mechanically or with a vacuum.

The control and analysis unit 30 comprises a digital processor and associated memory. The processor is programmed to control the rotating unit 28 and the emitter/detector pairs 20, 24, and to process the signals received from the detectors. Alternatively, an analogue computer or hardware components could be used to perform the same functions.

In operation, the control and analysis unit 30 sends a signal to the rotating unit 28 which causes the rotating unit to start rotating the cigarette. The control and analysis unit 30 also sends signals to the emitter/detector pairs 20, 24, which cause the emitters to turn on. The control and analysis unit 30 then monitors the signals from the two detectors.

As the cigarette is rotated, the signals from the detectors stay approximately constant, until a seam is encountered. When a seam is encountered, a shadow is cast due to the oblique angle at which the emitter illuminates the cigarette. The shadow causes a decrease in the intensity of the radiation detected by the detector.

Figure 5:
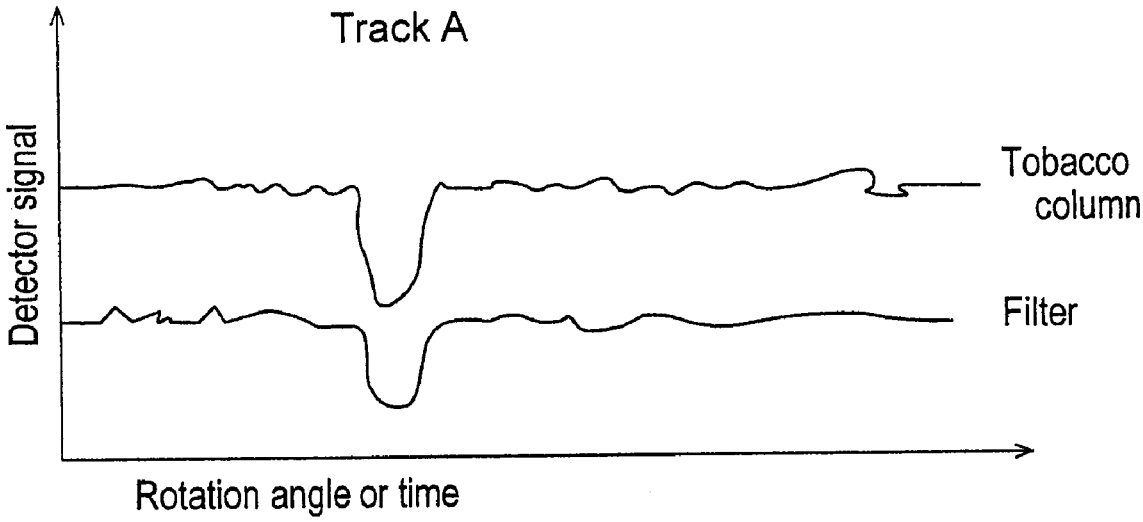
FIGS. 5 and 6 show signals produced by the testing apparatus of FIGS. 3 and 4.

FIG. 5 shows the signals produced by the two detectors when a cigarette from track A of FIG. 2 is tested. The top line in FIG. 5 shows the signal from the detector adjacent the tobacco column, while the bottom line shows the signal from the detector adjacent the filter. In each case there is a dip in the intensity of the signal as the seam passes the area of illumination. In FIG. 5, the seam of the filter paper is aligned with the seam of the tobacco wrapping paper, and therefore the dips in the two signals occur at substantially the same time.

Figure 6:
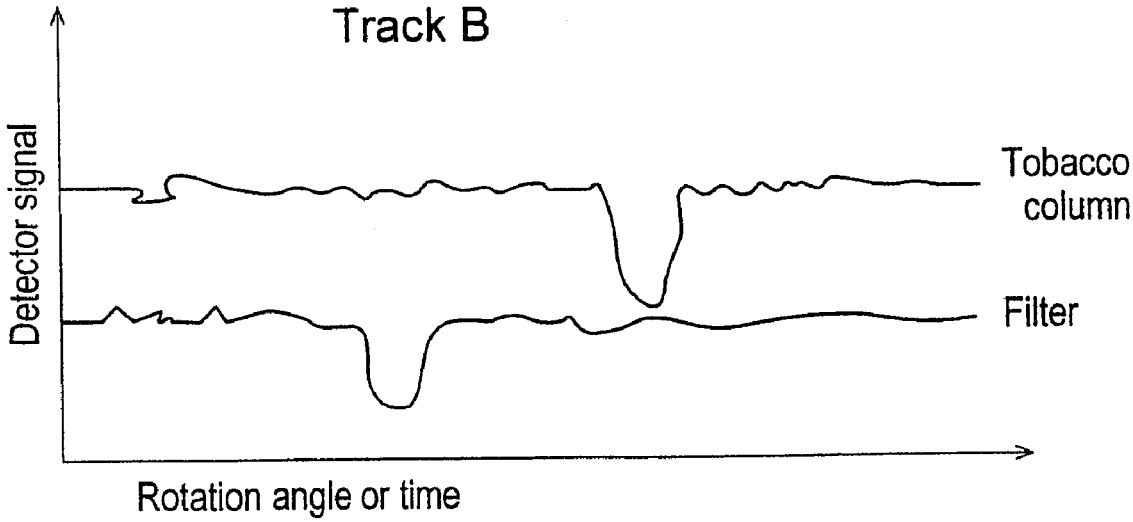

FIG. 6 shows the signals produced by the two detectors when a cigarette from track B of FIG. 2 is tested. The top line in FIG. 6 shows the signal from the detector adjacent the tobacco column, while the bottom line shows the signal from the detector adjacent the filter. As in FIG. 5, there is a dip in the intensity of each signal as the seam passes the area of illumination. However, in FIG. 6, the seam of the filter paper is not aligned with the seam of the tobacco wrapping paper, and therefore the dips in the two signals occur at different times.

The signals from the two detectors are compared in the control and analysis unit 30. If the control and analysis unit determines that the dips in the signals occur at substantially the same time, then it outputs a signal indicating that the cigarette under test originates from track A. If the control and analysis unit determines that the dips in the signals occur at different times, then it outputs a signal indicating that the cigarette under test originates from track B.

Once a complete revolution has taken place, or when two dips in the signal have been detected, the control and analysis unit 30 stops rotation of the rotating unit 28 and turns off the emitters. The cigarette under test is then ejected and a new cigarette loaded ready for a new test.

If desired, the control and analysis unit 30 may also determine the angle between the filter paper and tobacco paper seams, by measuring the time between the dips and multiplying this by the angular velocity of the cigarette. The control and analysis unit may store the angular velocity of the cigarette in its memory, or it may itself control the rotational speed of the rotating means in order to control the angular velocity. The angle between the seams may be output to another device and/or used as part of the analysis of the cigarette.

Although not shown in FIGS. 5 and 6, the size of the dip in the signal may depend on the wrapping direction of the paper under test. This is because the cigarette is lit obliquely by the emitter 34 as shown in FIG. 4, and thus a seam which faces towards the emitter will cast less of a shadow than a seam which faces away from the emitter. Thus, with reference to FIG. 4, a paper which is wrapped clockwise will cause a greater dip in the signal than a paper which is wrapped anti-clockwise. The control and analysis unit 30 may compare the size of the dip with a threshold value, and determine the wrapping direction in dependence on whether the dip is above or below the threshold value. In this way, the control and analysis unit may also determine the line of origin of the cigarette.

Figure 7:
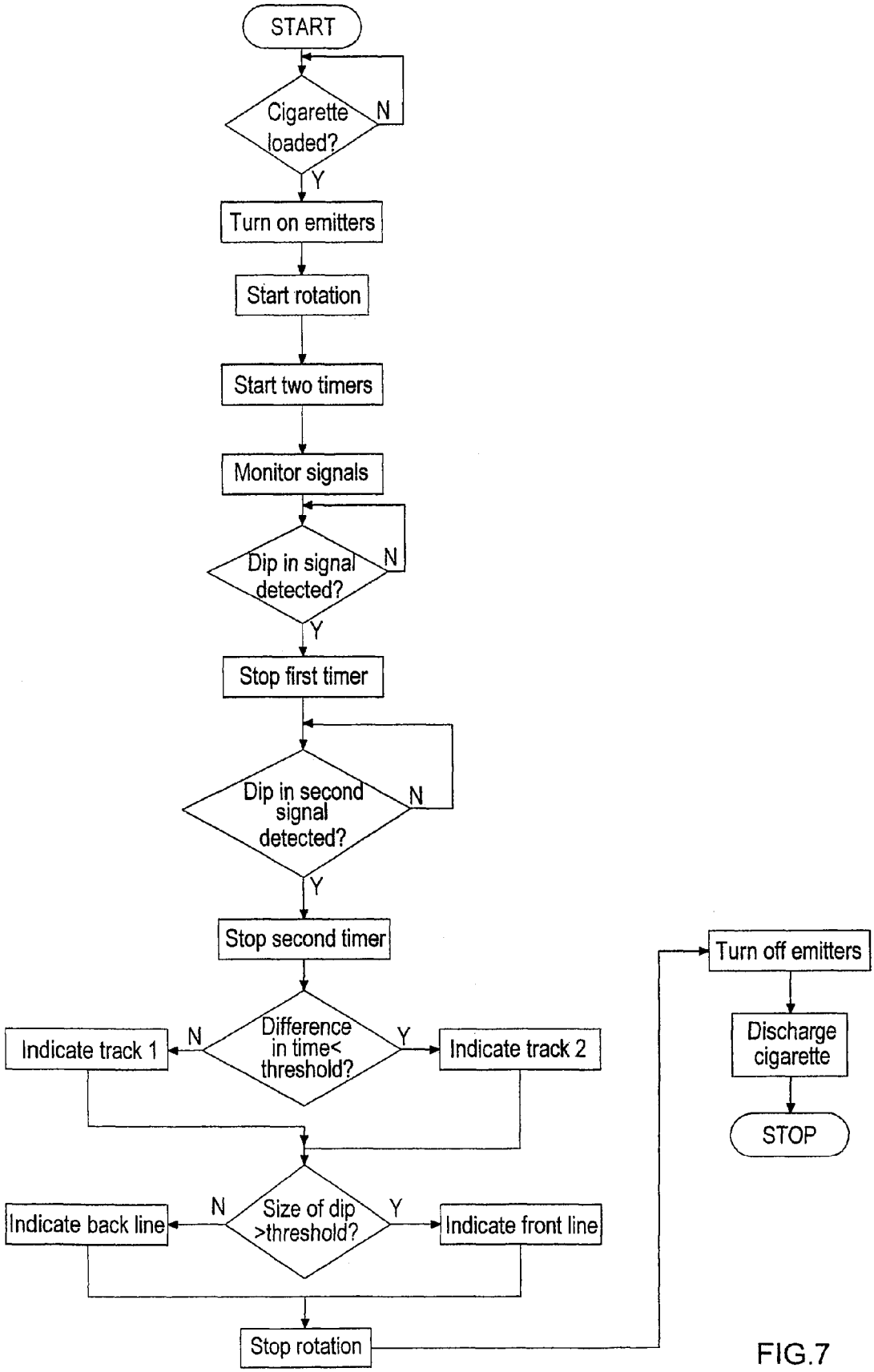
FIG. 7 shows steps carried out by a control and analysis unit in an embodiment of the invention.

FIG. 7 shows steps carried out by the control and analysis unit 30. Referring to FIG. 7, the control and analysis unit first monitors a signal from a cigarette loading unit to determine whether or not a cigarette to be tested has been loaded into the test apparatus. Once the cigarette is loaded, the emitters are turned on, and a signal is sent to the rotating unit to cause the cigarette to start rotating. Two timers are then started, and the signals from the detectors are monitored.

When a dip in one of the signals is detected, the first timer is stopped. When a dip in the other signal is detected, the second timer is stopped. The difference in the values of the timers is then compared to a threshold value. If the difference is less than the threshold, then it is decided that the filter paper and tobacco paper seams are substantially aligned, and a signal is output indicating that the cigarette is from track A. If the difference is greater than the threshold, then it is decided that the filter paper and tobacco paper seams are not aligned, and a signal is output indicating that the cigarette is from track B.

The sizes of the dips in the signals are then compared to another threshold value. If it is determined that the size of a dip is greater than the threshold value, then it is decided that the corresponding paper is wrapped in a clockwise direction and a signal is output indicating that the cigarette is from the "front" line. If it is determined that the size of a dip is less than the threshold value, then it is decided that the corresponding paper is wrapped in an anti-clockwise direction and a signal is output indicating that the cigarette is from the "back" line.

If required, the cigarette may be rotated a number of times in order to confirm the results. Once the track and line of origin have been determined, rotation is stopped, the emitters are turned off, and the cigarette is discharged. The process may then be repeated for another cigarette.

In another arrangement, two emitter/detector pairs are provided adjacent the cigarette filter, and two emitter/detector pairs are provided adjacent the tobacco column. In this arrangement, the filter and tobacco column are both lit from the left hand side by one emitter (as shown in FIG. 4), and from the right hand side by another emitter. This can allow the seams to be detected with greater certainty regardless of the wrapping direction, since a shadow will generally be cast in one direction or the other, and thus a significant dip will be produced in one signal or the other. This arrangement can also allow the wrapping direction to be determined by comparing the sizes of the dips in the signals produced by the two detectors adjacent each part of the cigarette. Thus, this arrangement may also facilitate the determination of line of origin.

In any of the above arrangements, shields may be provided between the various emitter/detector pairs. Alternatively or in addition the emitter/detector pairs may be operated in sequence and/or different wavelengths may be employed to avoid interference.

In an alternative embodiment, a single emitter/detector pair is provided, and tests are carried out sequentially at the filter and the tobacco column. In this embodiment means are provided for moving the cigarette relative to the emitter/detector to enable the tests to be performed. Alternatively a light beam may be deflected or scanned over different parts of the cigarette.

In any of the above arrangements, rather than rotating the cigarette, the emitter/detector pairs may be rotated about the cigarette, or the emitter/detector pairs and the cigarette may both be rotated.

Figure 8:
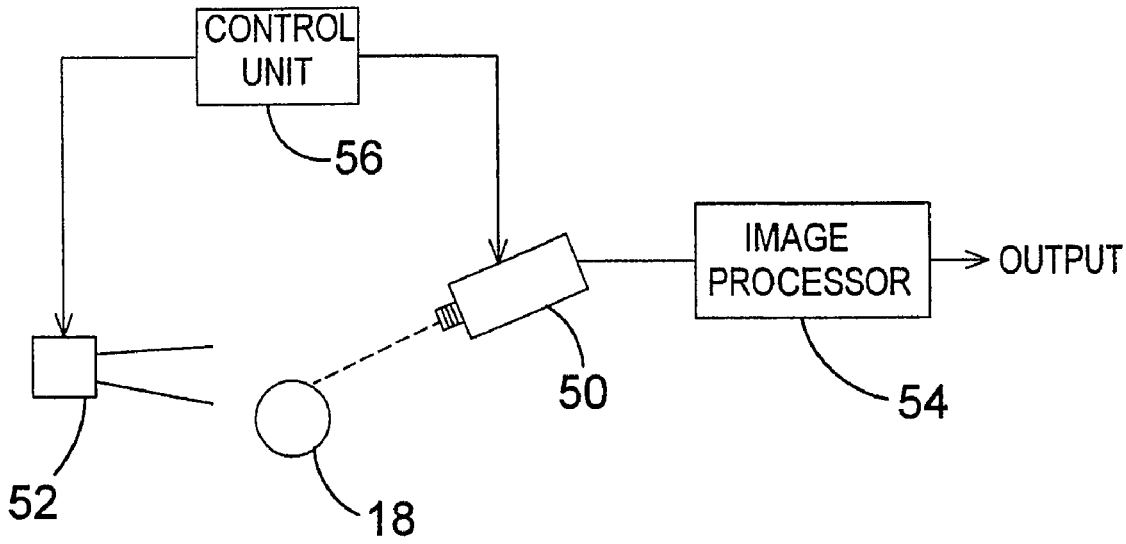
FIG. 8 shows parts of a testing apparatus in another embodiment of the invention.

FIG. 8 shows parts of a testing apparatus in another embodiment of the invention. In the embodiment of FIG. 8, a detector array 50 is positioned such that its field of view is at an angle to a cigarette under test 18. The cigarette is lit obliquely by an emitter 52 which is positioned on the other side of the cigarette. The output of the detector array is fed to an image processor 54. Rotating means (not shown) are provided to rotate the cigarette 18 about its axis in the field of view of the detector array 50. The rotating means may be the rotating unit 28 described above with reference to FIG. 4, or some other mechanism such as a chuck. The detector array, emitter and rotating means are controlled by a control unit 56.

In operation, the cigarette is rotated and the image processor 54 processes the signals from the detector array 50. If there is a change in the intensity of adjacent pixels in a direction corresponding to the circumferential direction of the cigarette, and this change in intensity occurs along a line corresponding to the axial direction of the cigarette, then it is determined that a seam is present in the field of view of the detector array. The image processor is arranged to compare the relative locations of the seams in the filter paper and tobacco paper, in order to determine the track of origin. A signal indicating track of origin is output by the image processor.

In the arrangement of FIG. 8, a seam which faces towards the emitter 52 will cast less of a shadow than a seam which faces away from the emitter. Thus, a paper which is wrapped in an anti-clockwise direction will cast less of a shadow than a paper which is wrapped in a clockwise direction. This characteristic is exploited by the image processor 54, which determines the number of pixels in which there is a change in intensity, and the intensity of the change. In this way, the image processor is able to determine whether the paper is wrapped in a clockwise direction or an anti-clockwise direction, and to output a signal indicating track of origin.

In another embodiment, the testing apparatus is based on a modified version of that disclosed in WO 2004/083834, the contents of which are incorporated herein by reference. By analysing the image of the cigarette as it is rotated, the shadow cast by the seam can be detected for the filter and the tobacco column. The relative positions of the seams can then be used to determine track of origin.

Where an imaging device is used, it may also be possible to determine the wrapping direction of the filter tipping paper and/or the tobacco column in the way disclosed in WO 2004/083834. It may then be possible to determine both track of origin and line of origin.

In another embodiment, the filter paper and the tobacco wrapping paper are imaged simultaneously using a long contact image sensor, such as that disclosed in co-pending United Kingdom patent application GB 0915394.1, the contents of which are incorporated herein by reference. The contact image sensor has imaging capabilities which are very large in one lateral direction, and small (e.g. one or a few pixels) in an orthogonal direction. This arrangement gives high magnification of a narrow strip along the length of the cigarette, and thus allows imaging of the whole cigarette without loss of resolution. Furthermore, this arrangement retains the relative positional integrity of the two seams irrespective of any slipping or non-uniformity during rotation. This method may also be used to determine the direction of wrap.

In any of the above embodiments, the line of origin can also be determined based on the actual wrapping direction of the tobacco wrapping paper or the filter tipping paper.

Any combination of the various techniques disclosed above can be used to determine track and/or line of origin.

The techniques for determining the track of origin discussed above may be incorporated into a test station which is used to test the properties of cigarettes sampled from the mass flow. In the test station, the cigarette properties are compared with specified tolerance limits, and out of limit characteristics are notified together with track and/or line of origin. Adjustments can then be made to the correct track or line of the maker on the basis of the determination of the track or line origin. These adjustments may be made manually or automatically.

Figure 9:
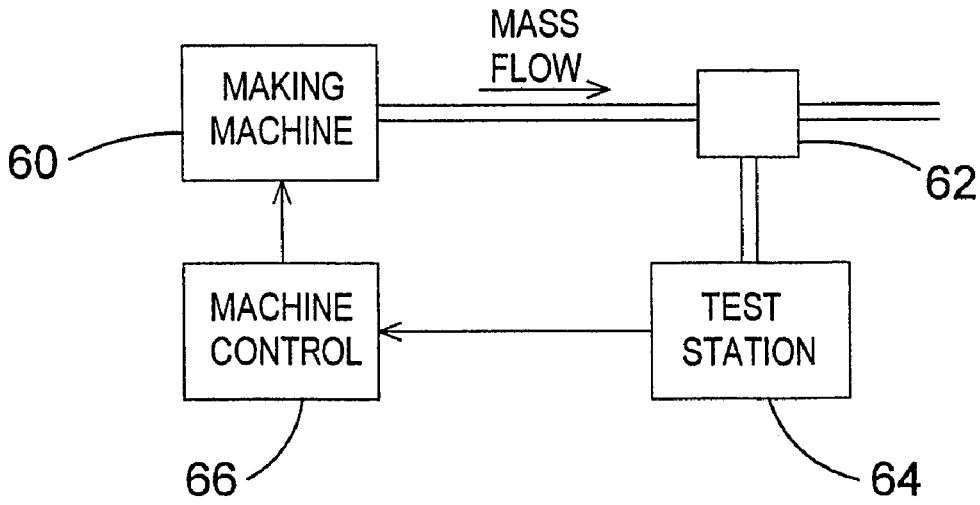
FIG. 9 shows parts of a system for manufacturing and analysing cigarettes.

FIG. 9 shows parts of a system for manufacturing and analysing cigarettes. The system comprises a twin track cigarette making machine 60, a sampling unit 62, a test station 64 and a machine control unit 66.

In the system of FIG. 9, the cigarette making machine 60 comprises two tracks, each of which produces two lines of cigarettes. The machine is set such that the circumferential position of the tipping paper seam and the circumferential position of the tobacco wrapping paper seam are different for each track. The cigarettes from both tracks are mixed in a mass flow at the output of the machine.

The sampling unit 62 samples cigarettes from the mass flow and feeds the sampled cigarettes to the test station 64. In the test station, the cigarette properties are compared with specified tolerance limits, and out of limit characteristics are identified. The test station is also arranged to determine the track of origin of the sampled cigarette in any of the ways described above.

If the test station 64 determines that the cigarette properties are outside of the tolerance limits, then the relevant characteristics are notified to the machine control unit 66, together with an indication of the track of origin and/or line of origin. In the system of FIG. 9, the control unit 66 is arranged to make the appropriate adjustments to the machine automatically. Alternatively the adjustments could be made manually by the machine operator.

While the preferred embodiment of the invention has been illustrated and described in the drawings and foregoing description, the same is to be considered as illustrative and not restrictive in character, it being understood that all changes and modifications that come within the spirit of the invention are desired to be protected.

The invention claimed is:

1. Apparatus which determines the track of origin of a cigarette manufactured in a cigarette making machine having a plurality of tracks, the machine is constructed and arranged such that a difference in the circumferential position of the tipping paper seam and the circumferential position of the tobacco wrapping paper seam is different for each of the plurality of tracks, the apparatus comprising:

a detector arranged to detect radiation from the cigarette and to produce a signal representative of the detected radiation; and a processor arranged to process the signal produced by the detector to identify a shadow cast by a tipping paper seam and a shadow cast by a wrapping paper seam, wherein the processor is arranged to determine the difference in the circumferential position of the shadow cast by the tipping paper seam and the circumferential position of the shadow cast by the wrapping paper seam, and to produce a signal indicating the track of origin of the cigarette in dependence thereon.

2. Apparatus according to claim 1, wherein each track of origin produces cigarettes of two lines of origin by forming a rod from a filter tip and two tobacco columns and cutting the rod to produce two cigarettes each having a different line of origin, and wherein the processor is arranged to determine a difference in at least one of the size and direction of the shadow cast by by the tipping paper seam and at least one of the size and direction of the shadow cast by the wrapping paper seam to produce an indication of the line of origin.

3. Apparatus according to claim 1, further comprising an emitter which emits radiation towards the cigarette.

4. Apparatus according to claim 3, wherein the emitter is arranged to emit radiation obliquely towards the surface of the cigarette.

5. Apparatus according to claim 3, wherein the emitter is arranged to emit radiation at an angle to the surface of the cigarette such as to cause a shadow to be cast by a seam in at least one of the tipping paper and the tobacco wrapping paper.

6. Apparatus according to claim 1, comprising two emitters located on either side of the cigarette, and arranged to emit radiation obliquely towards the cigarette from either side.

7. Apparatus according to claim 1, comprising an emitter/detector pair which emits radiation towards the cigarette and detects radiation from the cigarette.

8. Apparatus according to claim 7, comprising a first emitter/detector pair adjacent the tipping paper, and a second emitter/detector pair adjacent the tobacco column paper.

9. Apparatus according to claim 7, further comprising an adjustment unit which adjusts the relative positions of the cigarette and the emitter/detector pair such that the emitter/detector pair can emit radiation towards and detect radiation from the tipping paper and the tobacco column paper sequentially.

10. Apparatus according to claim 1, wherein the processor is arranged to detect a change in the amount of radiation detected by the detector.

11. Apparatus according to claim 1, further comprising a rotation unit which rotates the cigarette relative to the detector, and a control unit which controls the rotation unit.

12. Apparatus according to claim 1, wherein the detector comprises a detector array positioned such that its field of view is at an angle across the line of an expected seam of the cigarette, and the processor is arranged to detect a change in the intensity of adjacent pixels of the detector array as the cigarette rotates.

13. A system for manufacturing and analysing cigarettes, the system comprising:

a cigarette making machine having a plurality of tracks, wherein the machine is arranged such that a difference in the circumferential position of the tipping paper seam and the circumferential position of the tobacco wrapping paper seam are different for different tracks; and an apparatus which determines, the track of origin of a cigarette manufactured in the cigarette making machine, the apparatus comprising:

a detector arranged to detect radiation from the cigarette and to produce a signal representative of the detected radiation; and a processor arranged to process the signal produced by the detector to identify a shadow cast by a tipping paper seam and a shadow cast by a wrapping paper seam, wherein the processor is arranged to determine the difference in the circumferential position of the shadow cast by the tipping paper seam and the circumferential position of the shadow cast by the wrapping paper seam, and to produce a signal indicating the track of origin of the cigarette in dependence thereon.

14. A method of determining the track of origin of a cigarette manufactured in a cigarette making machine having a plurality of tracks, the method comprising:

setting the cigarette making machine such that a difference in the circumferential position of the tipping paper seam and the circumferential position of the tobacco wrapping paper seam is different for different tracks of origin;

detecting radiation from the cigarette and producing a signal representative of the detected radiation;

processing the signal to identify a shadow cast by a tipping paper seam and a shadow cast by a wrapping paper seam;

determining the difference in the circumferential position of the shadow cast by the tipping paper seam and the circumferential position of the shadow cast by the wrapping paper seam; and producing a signal indicating the track of origin of the cigarette in dependence on the difference.

* * * * *